United States Patent [19]

Weil

[11] Patent Number: 4,979,280

[45] Date of Patent: Dec. 25, 1990

[54] GASKET ASSEMBLY AND METHOD OF MAKING

[75] Inventor: Thomas L. Weil, Elverson, Pa.

[73] Assignee: Davlyn Manufacturing Co., Inc., Spring City, Pa.

[21] Appl. No.: 358,722

[22] Filed: May 30, 1989

[51] Int. Cl.[5] ..... B23P 11/00

[52] U.S. Cl. ..... 29/446; 29/452

[58] Field of Search ..... 29/446, 452; 49/479; 277/230; 87/6, 7; 174/35 GC

[56] References Cited

U.S. PATENT DOCUMENTS

| | | | |
|---|---|---|---|
| 2,219,962 | 10/1940 | Reynolds et al. | 49/479 |
| 3,578,764 | 5/1971 | Nunnally | 277/230 X |
| 3,812,316 | 5/1974 | Milburn | 49/479 X |
| 3,846,608 | 11/1974 | Valles | 277/230 X |

*Primary Examiner*—Joseph M. Gorski

*Attorney, Agent, or Firm*—Panitch Schwarze Jacobs & Nadel

[57] ABSTRACT

A gasket assembly is made by securing together in a flexible, elongated gasket subassembly, a first, elongated, flexible tube of braided glass fiber and an adjoining, flexible, second, elongated knit wire mesh tube member by sewing together the first tube and the second tube member. Braid of the first tube permits elongation of that tube under tension. The adjoining tubes are secured together along their lengths in states of elongation such that the second tube member is fully elongated under tension, to the extent permitted by its metal wire fabric, before the first tube is stretched to a maximum elongation permitted by the braid. The resulting elongated flexible assembly is threaded onto an elongated, substantially rigid frame member, preferably by threading the frame member through a sleeve formed in the knit wire mesh tube member by the stitching. The flexible subassembly is stretched under tension on the frame and portions of the second, knit wire mesh member are secured to the frame member under tension, preferably by spot welds, to hold the flexible subassembly under tension fixed to the frame.

9 Claims, 2 Drawing Sheets

GASKET ASSEMBLY AND METHOD OF MAKING

FIELD OF THE INVENTION

The invention relates to gasket assemblies and, in particular, to such assemblies including an elongated flexible gasket subassembly mounted on a substantially rigid frame for shaping the gasket and for mounting the gasket, for example to an appliance such as a range.

BACKGROUND OF THE INVENTION

The present invention is directed to overcoming difficulties encountered with various prior art assemblies for gasketing appliance doors, particularly doors of self-cleaning electric ovens.

In such ovens, it is common to mount a flexible glass fiber gasket to the oven door or around the face of the oven to substantially seal the space existing between the door and the face of the oven.

In one prior construction, a resilient, flexible knitted wire mesh tube was inserted into a larger diameter, braided, glass-fiber tube to form a flexible gasket subassembly. A sleeve was formed in one side of the glass fiber tube by sewing together a excess portion of the glass fiber tube along the length of that tube. In this way, the knitted, wire mesh tube was relatively closely held in one portion of the braided glass fiber tube on one side of the stitching and the sleeve was formed by the remainder of the glass fiber tube on the other side of the stitching. The sleeve was thereafter threaded onto an elongated steel member forming a substantially rigid frame to form the gasket assembly.

In one configuration, the ends of the flexible subassembly were secured on the frame by butting or telescoping the ends together and stapling them. In another configuration, the flexible subassembly extended substantially but not completely around the metal frame. Ends of the flexible subassembly were secured to the frame by metal hooks. An end of each hook was inserted through the braided glass fiber tube in the region of the stitching and an opposing end of the hook welded to the metal frame.

The metal frame, which was rectangular in shape, held the flexible subassembly in an identical rectangular shape. The sleeve of the braided tube and the metal frame within formed a tail extending from a remaining, essentially cylindrical and deformable portion of the assembly. The tail was inserted between panels of an oven door or panels of the body of the oven facing the door, to secure the assembly in position.

There were certain drawbacks associated with this construction. These drawbacks related to both the method of fabrication and the gasket assembly resulting from that method.

First, the methods employed for securing the gasket assembly on the frame were not easy to perform. The hooks were particularly burdensome as they had to be initially fabricated and then secured to the metal frame but only after the flexible subassembly had been threaded onto the metal frame. Moreover, when the hooks were eliminated and the ends of the flexible assembly were stapled together, there was the possibility of the braiding unraveling at the staple(s), resulting in a loss of tension in the subassembly and possibly a complete separation of the ends of the braiding, and the undesired movement of the subassembly around the frame.

Second, tensioning the braided glass fiber jacket sufficiently to cause it to lie smoothly along straight portions of the frame while not bunching up along the inside of curves of the frame was difficult, if not impossible. When greater tension was applied to the braided tube to smooth it at the curves, the braid had a tendency to flatten into the curve to relieve tension and further to narrow in diameter along straight portions of the assembly. This often led to problems with sealing between the oven door and face of the oven apparently due to uneven diameter of the braided glass tube along the frame.

Yet another gasket assembly has been used which consists of two braided glass fiber tubes positioned adjoining one another and sewn to one another along their lengths. An enlarged sleeve of one of the two glass fiber tubes contained a resilient, flexible knitted metal wire tube which formed the deformable portion of the gasket assembly. In a pocket formed in the second glass fiber tube, on the same side of the stitching as the knitted metal wire tube, a resilient metal wire frame member was inserted. This gasket assembly was installed along flange, the flange being positioned between the two braided glass fiber tubes. In that way, the glass fiber tube with flexible, deformable knit wire inner tube would be exposed on an "outer" surface of the flange while the second braided glass tube and metal wire frame member could be concealed on a "hidden" side of the flange.

This particular construction with the knit metal wire tube and resilient metal frame member on the same side of the stitching resulted in substantially uniform bending of the two braided glass fiber tubes at corners of the supporting flange. The drawback of this construction is that it is essentially usable only with the provision of such a supporting flange and was not useful with other types of oven and oven door construction, particularly those having inside as opposed to outside curves.

SUMMARY OF THE INVENTION

In one aspect, the invention is a method of making a gasket assembly comprising the steps of: securing together in a flexible, elongated subassembly, a first elongated, braided flexible tube and an adjoining, second, elongated flexible member, the braid of the first tube permitting an elongation of the first tube under tension, the second member being formed of metal wire fabric, the adjoining first tube and second member being secured together along their lengths in states of elongation such that the second member may be fully elongated under tension to the extent permitted by the metal wire fabric before the first tube is stretched to a maximum elongation permitted by the braid. The method further comprises threading the elongated, flexible subassembly onto an elongated, substantially rigid frame member forming a substantially rigid frame, stretching the subassembly under tension on the rigid frame, and securing portions of the second member with the frame member under tension to hold the subassembly under tension fixed to the frame.

In another aspect, the method also includes the gasket assembly fabricated by the aforesaid method.

BRIEF DESCRIPTION OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DESCRIPTION OF PREFERRED EMBODIMENTS

Figure 1:
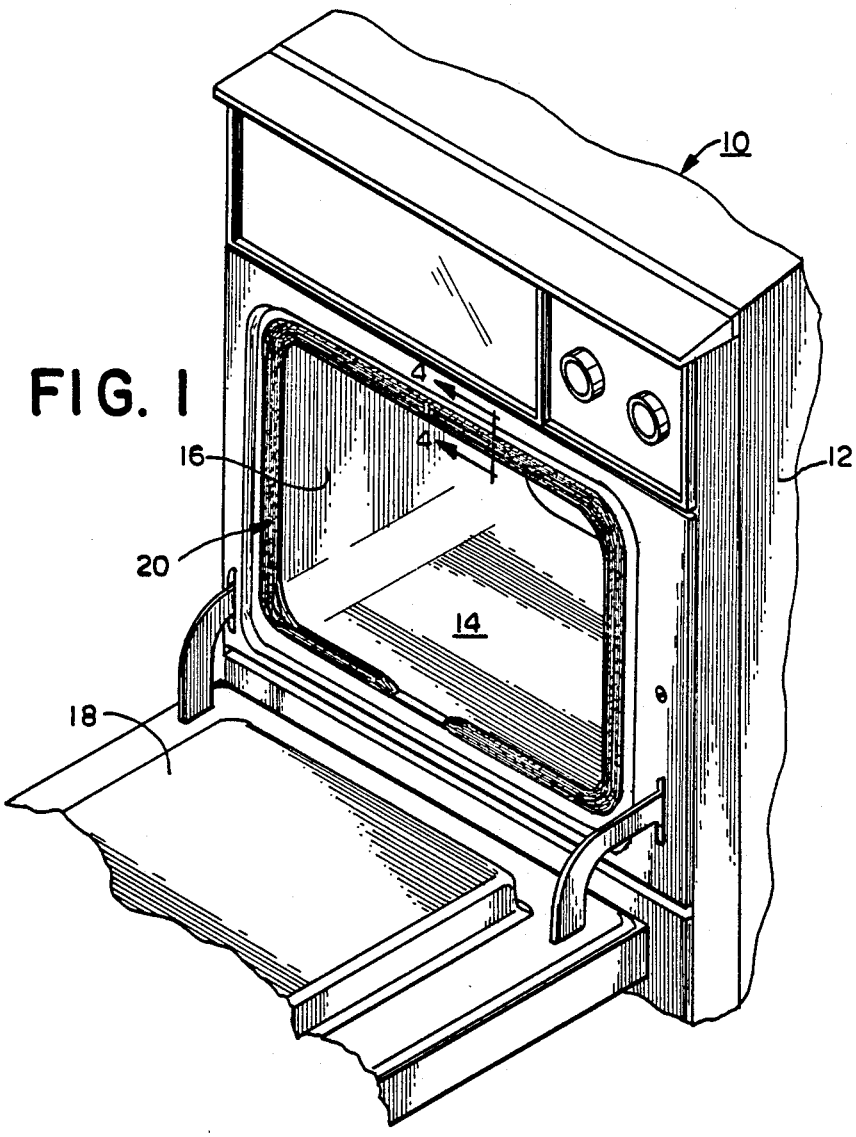
FIG. 1 is a schematic, perspective view of a gasket assembly according to the present invention installed in the face of an oven.

In the drawings, like numerals are employed to indicate like elements throughout.

FIG. 1 depicts diagrammatically a preferred appliance with which the gasket assembly of the present invention is used, namely a conventional electric range, a portion of which is indicated generally at 10. The range 10 includes a sheet metal body 12 and an oven compartment 14, preferably self-cleaning, formed in a conventional fashion by a cubical oven liner 16. The oven compartment 14 is substantially closed on all sides except the front, which is seen open in FIG. 1, and is disposed within the sheet metal body 12. The range 10 is further provided with a pivotally mounted door 18 adapted to cover and close the open side of the oven compartment 14.

The gasket assembly of the present invention is indicated generally at 20 and is mounted is as to surround the open side of the oven compartment 14. The gasket assembly 20 is positioned to be contacted and compressed by the door 18, when the door 18 is pivoted upright to a closed position, to seal the open side of the oven compartment 14 against the entrance of air and the exit of smoke.

Figure 2:
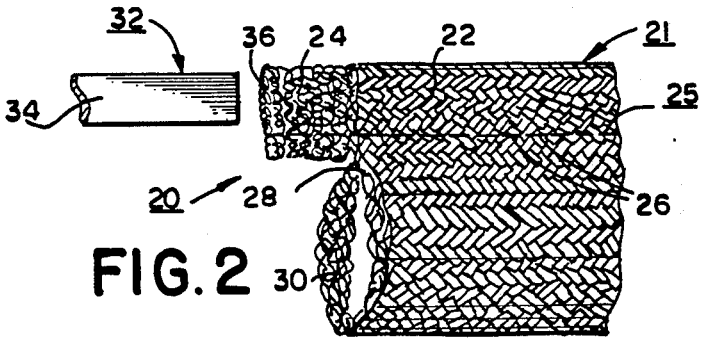
FIG. 2 is a "plan" view of the gasket assembly during assembly, broken away in stages.

The construction of the gasket assembly 20 is best seen in FIG. 2 in which the assembly 20 is broken away in various stages. The assembly 20 includes two major components: a flexible, elongated gasket subassembly 21 and a substantially rigid frame 32. The subassembly 21 includes a first, elongated, braided flexible tube 22. The first tube 22 is secured together in the subassembly 21 with an adjoining, second, elongated flexible member 24. The adjoining first tube 22 and second member 24 are secured together along their lengths with securing means, preferably in the form of glass fiber stitching 25.

Preferably, the braid of the first tube 22 is formed of essentially inelastic glass fiber. However, the braid itself permits an elongation of the first tube 22 under tension. The first tube 22 may be stretched to a maximum elongation permitted by the braid from a relaxed, untensioned state.

Preferably, the second member 24 is formed of metal wire fabric. More particularly, the second member 24 is preferably formed of wire knitted into the form of a seamless second tube. Stitches 26 of the stitching 25 pass through both sides of a portion of the first tube 22 and both sides of a portion of the second member 24, the knitted metal wire tube. The stitches 26 define a sleeve 28 along the first tube 22 on one side of the securing means stitching 25. A third, elongated, flexible, generally cylindrical member 30 is located in the first sleeve 28 on the one side of the securing means stitching 25. Preferably, the third member is also a seamless hollow tube of knitted wire, the wire preferably being sufficiently hardened (a tensile strength greater than about 150,000 psi, more desirably about 200,000 psi or more and preferably about 300,000 psi or more) to impart spring action to the third member 30 making the third member resiliently deformable.

The stitching 25 simultaneously defines a sleeve 36 along the second tube member 24 on a side of the securing means stitching 25 opposite the sleeve 28 of the first tube member 22 containing the third cylindrical member 30. The elongated, flexible subassembly 21 is threaded onto the elongated, substantially rigid frame member 34 which ultimately forms the substantially rigid frame 32. In particular, this is preferably accomplished by threading the frame member 34 through the second tube member 24 and, in particular, the sleeve 36 defined along the second tube member 24 on the side of the securing means stitching 25 opposite the first tube sleeve 28 and the third cylindrical member 30.

The use of a metal fabric second member 24 and a resilient metal frame member 34 provides several benefits. First, it is possible to secure portions of the second, metal wire tube member 24 directly to the metal frame member 34 under tension by fusing. Where the metal wires of the second tube member 24 and the frame member 34 are steel, portions of the metal wires may be spot welded to the frame member 34. Where nonferrous metals are involved, other forms of fusing such as braising or even soldering might be employed. In this way, the flexible subassembly 21 may be held under tension on the frame 32 for good positioning.

A second advantage of the metal construction is that the knit of the metal wire fabric of the second member 24 permits a predetermined amount of elongation of the second member 24 while that member 24 is secured to the first braided tube 22. In particular, the first braided tube 22 and second knitted wire tube member 24 are secured together along their lengths with the stitching 25 in states of elongation such that the second member 24 may be fully elongated under tension to the extent permitted by the knit of the metal wire fabric before the first tube 22 is stretched to a maximum elongation permitted by the braid. In this way, the knit wire second member may be fully elongated when the subassembly 21 is stretched under tension on the frame 32 without tensioning the first braided tube 22 sufficiently to distort that tube 22. This tends to prevent bunching or wrinkling of the first tube 22 at the corners of the frame 32 and further prevents excessively reducing the diameter of the braided tube 22 along the straight portions of the frame 32. Thus, the diameter of the braided tube 22 is kept more uniform all around the frame 32 reducing the likelihood of leaks.

A third advantage of using a knit wire tube 24 to receive the metal frame member 34 is that the knit wire tube 24 slides freely and easily onto the metal wire frame member 34, considerably more freely and easily than does a braided glass fiber tube of comparable dimension. This beneficial result is further improved by the use of at least partially hardened wire (tensile strength greater than about 150,000 psi, desirably about 200,000 psi or more and preferably about 300,000 psi or more). At least partially hardening the wire imparts a spring-like resiliency to the second tube member 24, the resiliency increasing with hardness up to about 340,000 psi. The hardened wire tends to hold the sleeve 36 of that tube member 24 open and to prevent distortions of that tube member 24 by the metal frame member 34 when the subassembly 21 is being threaded onto the metal frame member 34.

Construction of the gasket assembly 20 is straightforward and relatively simple. Knitted wire tubes used as the second and third members 24 and 30 can be purchased from any of a variety of commercial sources including, but not limited to, Davlyn Manufacturing Co., Inc., Spring City, Pa.; Montgomery Company, Windsor Locks, Conn. and ACS Industries, Woonsocket, R.I. A preferred knitted wire tube for use as an oven door gasket might be made of seven mil, full hard, 304 stainless steel wire in a continuous jersey knit having twelve wales and thirteen±one courses/inch to form a continuous knit, cylindrically shaped, hollow flexible tube approximately one-half inch in diameter. The specification for a wire knitting machine (not depicted) to knit a hollow wire core as described would be ⅞ inch cylinder, twelve needles, eighteen gauge, circular jersey knitting machine.

One of the preferred knitted wire tubes may be initially located in the first tube by being passed through a braided glass fiber tube approximately one inch in diameter or such a tube may be braided around the knitted wire tube with a conventional glass fiber braiding machine. None of these steps or such machines are depicted. A typical specification for the braided tube might be, for example, seventy-two ends of yarn (glass fiber) size-150's ten count, twenty±one picks per inch. Such braiding machines can be obtained from a variety of commercial sources including, but not limited to, Wardwell Braiding Machine Co., Central Falls, R.I. and Braider Manufacturing Company-Kokobun, Inc., Nakajimacho, Hamamatsu, Japan. The typical specification for such a machine is a seventy-two carrier braider, number two butt, thirty-six by one hundred gear ratio with a twenty-four inch capstan.

After locating the tubular knit wire member 30 within the first braided glass fiber tube 22, either by insertion or by braiding around the knit wire tube member 30, the first braided tube 22 and cylindrical metal wire member 30 contained therein are positioned adjoining the other knit wire tube 24 and the mutually adjoining tubes 22 and 24 passed through a sewing machine (not depicted). The sewing machine sews the adjoining braided first tube 22 and metal wire tube member 24 together along their lengths, compressing those tubes 22 and 24 and squeezing the third, metal wire tubular member 30 within the braided tube 22 to one side of the stitches 26.

Preferably, the first braided tube 22 and second flexible knitted wire tube member 24 are passed through the sewing machine under different tensions so as to be stretched to different states of elongation when secured together. Preferably, the second tubular knitted wire member 24 is stretched substantially to the full extension permitted by the knit. For the suggested knits indicated earlier, that extension is between about eight and twelve percent of the relaxed length of the tube 24. Tensioning may be provided on the second, knit wire tube member 24 by coupling that tube to a take-up mechanism downstream of the sewing machine (neither depicted), while placing a resistance on the remaining portion of the second, knitted wire member upstream. The resistance can be applied, for example, by having the take-up mechanism downstream of the sewing machine pull the second, knitted wire tubular member directly from a knitting machine or from a supply reel which is partially braked or is driven or geared at a slower speed than that of the take-up mechanism. In contrast, the first braided tube 24 and contained third cylindrical member preferably are fed freely into the sewing machine, with the only possible tension being the weight of an unsupported portion of the length of first braided tube and third cylindrical member being fed into the sewing machine and/or friction of first tube sliding into the sewing machine. When fed in this manner, the second, knit wire tube member 24 is stretched substantially to a maximum elongation permitted by the wire knit fabric of that member while the adjoining first braided tube is stretched only to a partial extent of a maximum elongation permitted the first tube by the braid of that tube. As a result, after sewing, the second member 24 fully elongates under tension to the extent permitted by the knit of the metal wire fabric of that member before the first tube 22 is stretched to the maximum elongation permitted by the braid of that tube.

Figure 3:
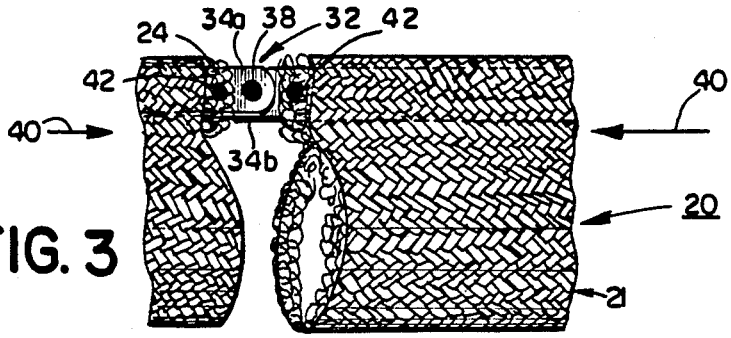
FIG. 3 shows the joining of ends of a frame member to form a substantially rigid frame and the joining of end portions of the flexible gasket subassembly to the frame.

The flexible subassembly 21 thus formed by the three members 22, 24 and 30 is easily bent and collapsed and, depending upon the nature of the materials employed has a certain degree of resiliency radially and longitudinally, similar to elasticity. The subassembly 21 is threaded onto the member 34 forming the frame 32 as is indicated in FIG. 2. The frame member 34 preferably is bent to a predetermined shape before insertion to define the shape of the gasket assembly 20. Ends **34*a* and 34*b* of the frame member 34 are secured together by appropriate means such as one or more spot welds 38, as shown in FIG. 3, to form the substantially rigid frame 32. The flexible subassembly 21 is thereafter moved to a desired position on the frame 32 and stretched under tension on the frame 32 as indicated by arrows 40 in FIG. 3. Portions of the second, knitted wire tube member 24 are then secured to the frame member 34 under tension, preferably by spot welds 42, to hold the flexible subassembly 21 under tension on the frame 32. The ends of the flexible subassembly may be spaced from one another, in the manner depicted in FIG. 3, or butted together (not depicted) as desired. In the latter case the portions of the second knitted wire tube member 24 may be spot welded to the frame member 34 on an opposing side of the assembly 20 from that seen in FIG. 3**.

Figure 4:
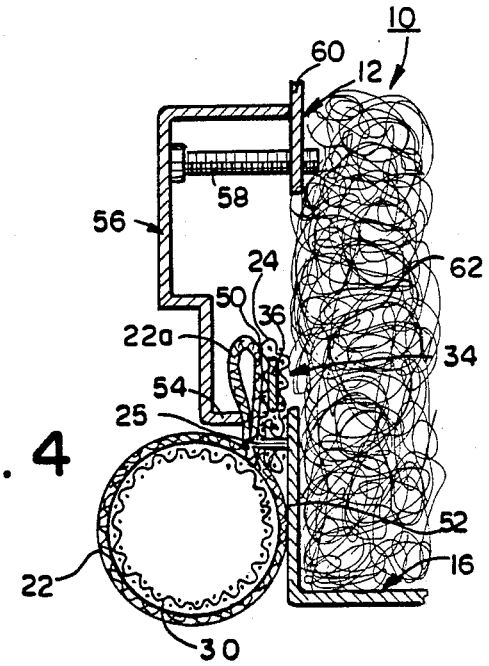
FIG. 4 depicts a cross-section of a portion of the gasket assembly and oven face along the lines 4—4 of FIG. 1.

The gasket assembly 20 is mounted to the range 10 as depicted in FIG. 1 in a manner better seen in FIG. 4, which depicts a cross-section of the range 10 of FIG. 1 along the lines 4—4. A tail portion 50 of the gasket assembly 20, which is formed by the stitching 25, sleeve 36 of the second flexible member 24 with the contained frame member 34 and an adjoining loop portion **22*a* of the first braided tube 22, all best seen in FIG. 2, are clamped between an upwardly turned, flange edge portion 52 of the cubicle oven liner 16 and an intersectingly positioned flange portion 54 of a stamped metal frame 56. The metal frame 5 is secured to other flange portions 60 of the sheet metal body 12 by conventional means such as mounting screws 58 passing through bores in the stamped metal frame 56 and into threaded openings in the other flange portions 60 of the sheet metal body 12. Not only can the stamped metal frame 56 be used to secure the gasket assembly 20 to the face of the range 10 but it may also be used to cover spaces between the cubicle oven liner 16 and the other portion 60 of the sheet metal body 12 between which insulation 62 such as rock wool may be inserted surrounding the cubicle oven liner 16**.

While a preferred embodiment of the invention has been disclosed, one of ordinary skill in the art will appreciate that other modifications are possible. For example, although a knit wire tube is preferred as the second member 2 of the gasket assembly 20 for receiving the member 34 of the frame 32, other metal fabric members conceivably might be employed such as a braided wire member or possibly even a square woven wire member or coil spring. Although a tube is preferred as the second member 24, it is conceivable that a planar second member 24 may be attached to the first braided tube 22 by being secured with the first braided tube 22 by separate sets of securing means so as to form a pocket or sleeve with the first braided tube 22 for receiving the member 34 of the frame 32. Although glass fiber is preferred for the first braided tube in an oven gasket construction, other inorganic, inelastic, flexible fibers, including metal fiber may be braided to form the first member 22. Similarly, although metal wire is the preferred material of fabricating the second member, it is conceivable though less preferable that other materials might be used, including but not limited to glass fiber. The second member preferably is of a knit and less desirably of a braided construction to provide a degree of elongation to that member. However, it is important that the braided tube and second member be joined to one another in relative states of elongation such that the second member will be fully elongated before the braided tube is itself fully elongated to the extent permitted by the braid.

From the foregoing description and comments, it is understood that this invention is not limited to the particular preferred embodiment disclosed, but is intended to cover any modifications which are in the scope and spirit of the invention, as defined in the appended claims.

I claim:

1. A method of making a gasket assembly comprising the steps of:

securing together in a flexible, elongated gasket subassembly, a first, elongated, braided flexible tube and an adjoining, second, elongated flexible member, the braid of the first tube permitting an elongation of the first tube under tension, the second member being formed of metal wire fabric, the adjoining the first tube and second member being secured to one another along their lengths in a manner such that when the subassembly is fully tensioned the second member is as fully elongated as the metal wire fabric permits while the first tube is only partially stretched to a maximum elongation permitted by the braid;

threading the elongated, flexible subassembly onto an elongated, substantially rigid frame member forming a substantially rigid frame;

tensioning the subassembly on the frame, thereby tensioning at least the second member; and securing portions of the tensioned second member of the tensioned subassembly to the frame member, thereby holding the subassembly under tension fixed to the frame.

2. The method of claim 1 wherein the second elongated member is a second tube formed of knitted metal wire and wherein the threading step comprises threading the frame member through the second tube.

3. The method of claim 2 wherein the wire of the second tube and the frame member are steel and the second securing step comprises spot welding portions of the wire to the frame member.

4. The method of claim 3 further comprising the step of initially locating a third elongated, flexible, generally cylindrical member in the first elongated tube and wherein the first securing step comprises the steps of locating the first elongated tube and the second tube side by side and passing securing means repeatedly through a pair of sides of the first tube and a pair of sides of the second tube such that the securing means defines at least one sleeve in a circumferential portion of the first tube extending between the pair of sides of the first tube, the at least one sleeve in the first tube extending along a first side of the securing means, the securing means simultaneously defining at least one sleeve in the second tube, the at least one sleeve in the second tubular member tube extending along a second side of the securing means opposite the first side of the securing means, the third member being located in the at least one sleeve of the first tube on the first side of the securing means and wherein the threading step comprises threading the frame member through the at least one sleeve of the second tube member on the second side of the securing means, whereby the third flexible member and the frame member are located on opposite sides of the securing means.

5. The method of claim 4 wherein the first securing step further comprises the simultaneous steps of stretching the second member substantially to a maximum elongation permitted by the wire fabric of the second member while stretching the adjoining first tube to only a partial extent of a maximum elongation of the first tube permitted by the braid of the first tube.

6. The method of claim 5 wherein the first securing step comprises the step of sewing the first tube and the second knitted metal wire tube together.

7. The method of claim 1 further comprising the step of initially locating a third elongated, flexible, generally cylindrical member in the first elongated tube and wherein the first securing step comprises the step of securing the first tube and the second member together with securing means extending repeatedly through a pair of sides of the first tube and through the second member such that the securing means defines at least one sleeve in a circumferential portion of the first tube extending between the pair of sides of the first tube, the securing means simultaneously defining at least a second sleeve extending along the subassembly, the third member being located in the at least one sleeve of the first tube and wherein the threading step comprises threading the frame member through the at least second sleeve defined by the securing means along the subassembly.

8. The method of claim 1 wherein the first securing step further comprises the simultaneous steps of stretching the second member substantially to a maximum elongation permitted by the wire fabric of the second member while stretching the adjoining first tube to a partial extent of a maximum elongation of the first tube permitted by the braid of the first tube.

9. The method of claim 1 wherein the first securing step comprises the step of sewing the first tube and the second metal wire member together.

* * * * *